US009351543B2

(12) United States Patent
Raymond

(10) Patent No.: US 9,351,543 B2
(45) Date of Patent: May 31, 2016

(54) CLOSURE ASSEMBLY INCORPORATING AN EASY ACCESS TAB INTEGRATED INTO HOOK AND LOOP FASTENER ELEMENTS AND METHOD FOR FORMING THE SAME

(71) Applicant: Central Lake Armor Express, Inc., Central Lake, MI (US)

(72) Inventor: Charles C. Raymond, Mancelona, MI (US)

(73) Assignee: Central Lake Armor Express, Inc., Central Lake, MI (US)

( * ) Notice: Subject to any disclaimer, the term of this patent is extended or adjusted under 35 U.S.C. 154(b) by 0 days.

(21) Appl. No.: 14/966,875

(22) Filed: Dec. 11, 2015

(65) Prior Publication Data

US 2016/0095392 A1 Apr. 7, 2016

Related U.S. Application Data

(63) Continuation of application No. 13/644,397, filed on Oct. 4, 2012, now Pat. No. 9,241,547.

(60) Provisional application No. 61/545,353, filed on Oct. 10, 2011.

(51) Int. Cl.

| | |
|---|---|
| ***A44B 18/00*** | (2006.01) |
| ***A41F 1/00*** | (2006.01) |
| ***A41D 1/06*** | (2006.01) |

(Continued)

(52) U.S. Cl.

CPC ..... *A44B 18/0069* (2013.01); *A41D 1/06* (2013.01); *A41D 13/0012* (2013.01); *A41D 13/0562* (2013.01); *A41F 1/00* (2013.01); *A44B 18/00* (2013.01); *A44B 18/0003* (2013.01); *F41H 1/02* (2013.01); *Y10T 24/27* (2015.01); *Y10T 24/2758* (2015.01)

(58) Field of Classification Search

CPC . A41D 13/0012; A41D 13/0562; A41D 1/06; A41F 1/00; A44B 18/00; A44B 1/003; Y10T 24/27; Y10T 24/2758; F41H 1/02

USPC ..... 24/442, 448, 452

See application file for complete search history.

(56) References Cited

U.S. PATENT DOCUMENTS

| | | | |
|---|---|---|---|
| 3,843,971 | A | 10/1974 | Delanty et al. |
| 4,075,716 | A | 2/1978 | Collins |

(Continued)

OTHER PUBLICATIONS

Final Office Action for U.S. Appl. No. 13/644,397 dated Jun. 12, 2015.

(Continued)

*Primary Examiner* — Robert J Sandy
*Assistant Examiner* — David Upchurch
(74) *Attorney, Agent, or Firm* — Marshall, Gerstein & Borun LLP

(57) ABSTRACT

A releasable fastener assembly which includes a first panel carrying an area of a first engagement material; and a second panel carrying an area of a second engagement material. The first and second engagement materials are releasably securable to one another. A portion of a perimeter of the area of the second engagement material defines a recess which extends in a direction nonparallel to an edge of the second panel and into the area of the second engagement material. The recess is accessible from the edge of the second panel. Further included is a method for using the releasable fastener assembly.

18 Claims, 3 Drawing Sheets

(51) Int. Cl.

| | |
|---|---|
| ***A41D 13/00*** | (2006.01) |
| ***A41D 13/05*** | (2006.01) |
| ***F41H 1/02*** | (2006.01) |

(56) References Cited

U.S. PATENT DOCUMENTS

| | | | |
|---|---|---|---|
| 4,290,148 | A | 9/1981 | Roberts |
| 4,476,639 | A | 10/1984 | Zaccaria |
| 4,547,982 | A | 10/1985 | Gamm |
| 4,601,066 | A | 7/1986 | Campbell |
| 4,656,670 | A | 4/1987 | Schluter |
| 5,176,670 | A | 1/1993 | Roessler et al. |
| 5,401,275 | A | 3/1995 | Flug et al. |
| 5,504,944 | A | 4/1996 | Bromer et al. |
| 5,537,722 | A | 7/1996 | Niederhofer et al. |
| 5,554,146 | A | 9/1996 | Niederhofer et al. |
| 5,624,429 | A | 4/1997 | Long et al. |
| 5,688,137 | A | 11/1997 | Bustance |
| 5,692,240 | A | 12/1997 | Steele |
| 5,722,127 | A | 3/1998 | Coates |
| 5,901,376 | A | 5/1999 | Deirmendjian et al. |
| 5,926,926 | A | 7/1999 | Kato |
| 6,099,516 | A | 8/2000 | Pozniak et al. |
| 6,138,278 | A | 10/2000 | Taylor et al. |
| 6,374,414 | B1 | 4/2002 | Collier |
| 6,419,667 | B1 | 7/2002 | Avalon et al. |
| 6,508,797 | B1 | 1/2003 | Pozniak et al. |
| 6,564,386 | B2 | 5/2003 | Fujikawa et al. |
| 6,986,164 | B1 | 1/2006 | Morales |
| 7,168,103 | B2 | 1/2007 | Aldridge et al. |
| 8,127,370 | B2 | 3/2012 | Nunn |
| 8,403,719 | B2 | 3/2013 | Drennan et al. |
| 2002/0156406 | A1 | 10/2002 | Moore et al. |
| 2010/0132091 | A1 | 6/2010 | Young et al. |
| 2011/0086561 | A1 | 4/2011 | Drennan et al. |
| 2011/0231976 | A1 | 9/2011 | Herbener et al. |

OTHER PUBLICATIONS

Non-Final Office Action for U.S. Appl. No. 13/644,397 dated Nov. 4, 2014.

Final Office Action for U.S. Appl. No. 13/644,397 dated May 22, 2014.

Non-Final Office Action for U.S. Appl. No. 13/644,397 dated Oct. 23, 2013.

CLOSURE ASSEMBLY INCORPORATING AN EASY ACCESS TAB INTEGRATED INTO HOOK AND LOOP FASTENER ELEMENTS AND METHOD FOR FORMING THE SAME

CROSS-REFERENCE TO RELATED APPLICATIONS

This application is a continuation of U.S. patent application Ser. No. 13/644,397, entitled "Closure Assembly Incorporating an Easy Access Tab Integrated Into Hook and Loop Fastener Elements and Method for Forming the Same" filed Oct. 4, 2012 which claims priority to U.S. patent application Ser. No. 61/545,343, entitled "Easy Opening Velcro Fastener" filed Oct. 10, 2011, which is hereby incorporated herein by reference in its entirety.

FIELD OF THE INVENTION

The present invention discloses an easy access tab which is integrally defined into selected hook and loop fastener closure elements, such as which are inter-engaged in overlapping fashion in one example associated with an adjustable vest-like garment. The access tab exhibits a crushed subset surface area typically produced by an initial edge extending portion of the tab which is folded over against a forward and central most subset area of the hook surface and subsequently sonically heat bonded to itself as a single layer maintaining a low profile and without any significant weight addition. The crushed area formed within the entryway location of the hook surface enables a user to insert one or more digits (fingers or thumb) between the opposing hook and loop configured surfaces of the opposing closure elements to facilitate easier opening and without damaging the closure elements.

BACKGROUND OF THE INVENTION

Hook and loop attachment straps are known in the art for use in assisting in opening hook and loop configured closure elements. A problem with such conventional straps, which are typically secured in extending fashion from an edge proximate location of a given one of the closure elements, is that they typically lack any entryway or starting point for initiating controlled and effective "tear away" separation between the closures, this often resulting in damage in the instance of excessive pulling forces being exerted at locations of the closure elements which are not designed to withstand such heavy forces.

Additional attempts have included separating the fabric and webbing tabs to cover the hook teeth in order to create an easier control point, such requiring either thread stitching or glue with the undesirable result being a buildup of material layers with attendant undesirable extra weight.

Other known examples of prior art designs including the tactical shirt for carrying a concealed weapon which is depicted in U.S. Pat. No. 6,986,164 to Morales and which includes a hidden front pocket exhibiting an article supporting cavity accessible from a vertical opening line. A pair of hook and loop patches are provided between the overlaying panel and the shirt, with an opening between the two providing for access to the interior cavity. Disadvantages associated with the Morales construction include its limitation to being used with a cavity enclosure application as well as the use of multiple hook and loop portions (two hook and two loop).

Other secondary references of note include each of the adjustment system for length of a section of garment (U.S. Pat. No. 6,374,414 to Collier), the no lace shoe with adjustable strap fastening system (U.S. Pat. No. 4,476,639 to Zaccaria) and the surgical gown with pull tab closure (U.S. Pat. No. 4,290,148 to Roberts).

SUMMARY OF THE INVENTION

A releasable fastener assembly, which includes a first panel carrying an area of a first engagement material and a second panel carrying an area of a second engagement material. The first and second engagement materials are releasably securable to one another. A portion of a perimeter of the area of the second engagement material defines a recess which extends in a direction nonparallel to an edge of the second panel and into the area of the second engagement material and the recess is accessible from the edge of the second panel.

A releasable fastener assembly, which includes a first panel carrying an area of a first engagement material and a second panel carrying an area of a second engagement material wherein the second panel comprises an edge. The first and second engagement materials are releasably securable to one another. The area of the second engagement material includes a perimeter, wherein a portion of the perimeter, positioned between a first portion and a second portion of the perimeter, defines a recess which extends into the area of the second engagement material and in a direction nonparallel with respect to the edge of the second panel with the second engagement material positioned along the portion of the perimeter. The recess is positioned between the first and second panels with the first engagement material of the first panel and the second engagement material of the second panel releasably engaged and the recess is accessible from the edge of the second panel and from between the first and second portions of the perimeter.

A releasable fastener assembly, which includes a first panel carrying an area of a first engagement material and a second panel carrying an area of a second engagement material. The first and second engagement materials are releasably securable to one another. The second panel includes a tab wherein the tab has a fold positioned at an edge of the second panel and the tab overlies a portion of the second panel wherein the second engagement material is positioned along a perimeter of the tab surrounding at least a portion of the tab.

A method for using a releasable fastener assembly, which includes the step of providing a first and second panel releasably secured to one another. The first panel carries an area of a first engagement material and the second panel carries an area of a second engagement material in which the first and second engagement material is releasably securable to one another. A portion of a perimeter of the area of the second engagement material defines a recess which extends in a direction nonparallel to an edge of the second panel and into the area of the second engagement material with the recess accessible from the edge of the second panel. The method further includes the step of inserting at least one finger from the edge of the second panel into the recess positioned between the first and second panels.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
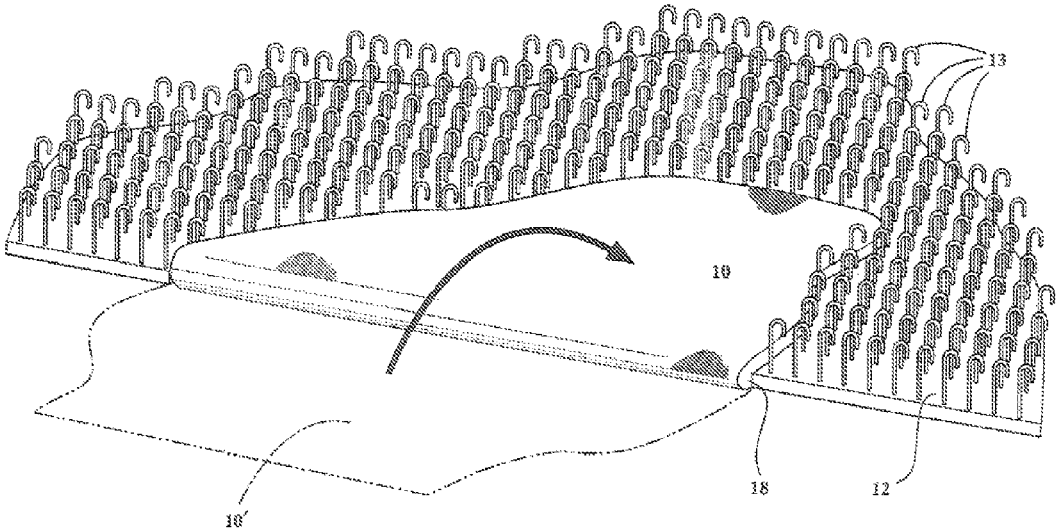
FIG. 1 is an environmental perspective of a hook closure element exhibiting the fold-over tab which is sonically heat bonded to create a consistent thickness gripping area relative to the surrounding area of the hook element.
Figure 2:
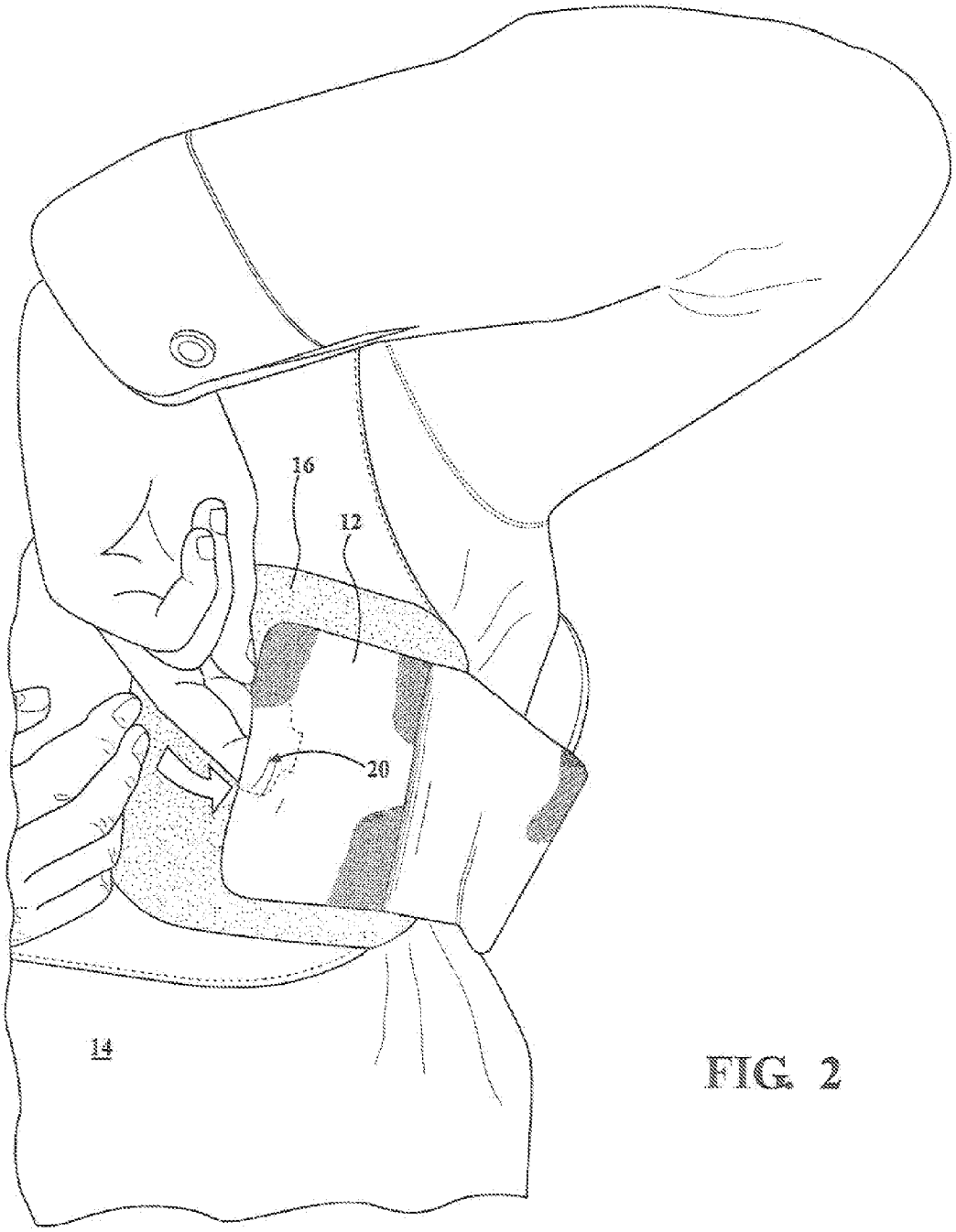
FIG. 2 is an operational perspective depicting a wearer of the garment inserting a pair of digits into the edge proximate access area provided by the tab and in order to provide consistent and controlled "tear away" separation between the hook and loop closure elements.
Figure 3:
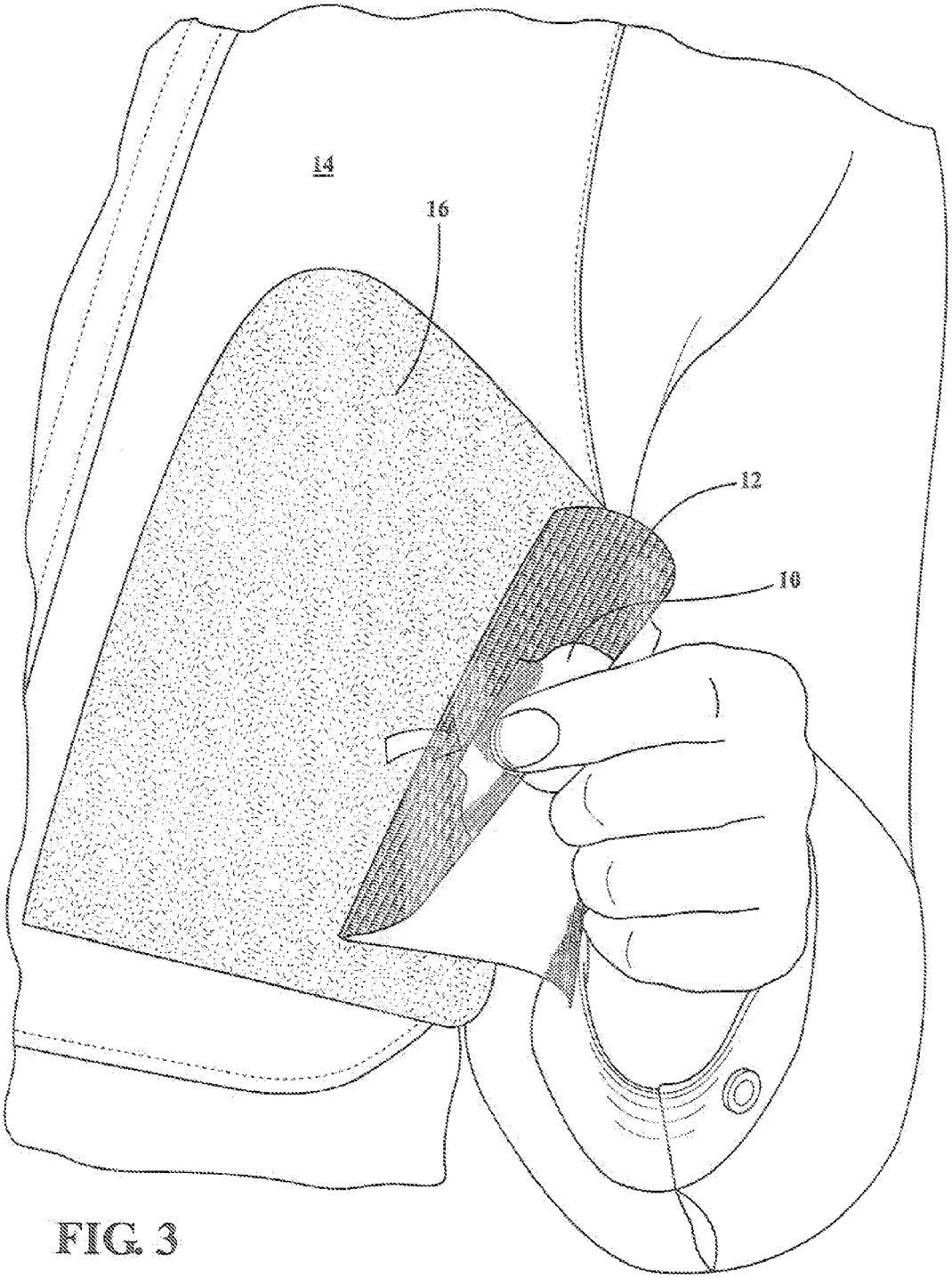
FIG. 3 is a succeeding illustration to that depicted in FIG. 2 and showing the hook closure element in substantially torn away fashion relative to the underlying loop configured surface built into the surface of the vest garment.

With reference to the illustrations set for as FIGS. 1-3, the present invention discloses an easy access tab integrated into a hook closure forming a portion of overlapping hook and loop engaging surfaces such as are associated with an adjustable vest-like garment or the like. FIG. 1 is an environmental perspective of a hook closure element exhibiting the fold-over tab 10 which is sonically heat bonded to create a consistent thickness gripping area relative to the surrounding area of a first closure 12 which depicts a large plurality of hook portions 13 on an inner facing surface.

As further depicted in FIGS. 2-3, the hook closure 12 defines an elongated panel (also termed a side strap) which extends from a separate side edge of a vest-like garment 14 (such as a ballistic style vest). The hook closure panel overlaps and engages, in an adjustable fashion, an underlying loop surfaced panel 16, such as which can be incorporated into a fixed surface location of the garment 14.

The tab as depicted at 10' in FIG. 1 initially exhibits an initial edge extending portion 18 which is folded over and against a forward and central most subset area of the hook surface of the closure 12, following which the smooth reverse surface of the tab 10 is sonically heat bonded which effectively melts the tab into the overlapped area of the hook closure to define a single integrated layer maintaining a low profile (i.e. retaining a thickness approximate to the surrounding region of the hook layer) and without any significant weight addition.

The crushed area formed within the entryway location of the hook surface enables a user to insert one or more digits (fingers or thumb) between the opposing hook and loop configured surfaces of the opposing elements to facilitate easier opening and without damaging the closure elements. A corresponding method if also disclosed for sonically heat bonding the reverse folded tab applied against the hook surface utilizing the above structure.

In this manner, the smoothened access area depicted at 20 in FIG. 2 is created by the tab 10 being folded over and sonically bonded against the underlying central location of the hook closure 12 and defines an integrated single layer which exhibits a thickness consistent with the surrounding areas of the hook closure 12 and without any significant additional weight.

It has also been found that the ability to avoid employing either a heat press for gluing the area 20, or a sewing machine in order to stitch an extra panel over a corresponding hook exhibiting surface of the closure 12, further results in preserving the integrity, shape and durability of the hooks 13 surrounding the smoothened (sonic heat bonded) area achieved through the article and process of the present invention. Further, and because the sonic bonded portion is fairly straightforward in construction, it enables easier modification in the creation of an overall tab shaping without fundamentally affecting operation (this including both holding and tear away forces).

A corresponding method of creating a smoothed gripping section associated with an entryway between first and second overlapping closures is also disclosed and includes the steps of providing an edge extending tab with a first strap extending closure exhibiting a hook surface configuration, reverse folding the tab over and against a forward and central most subset area of the hook surface of the closure, following which the tab is sonically heat bonded against the hook closure so that a smooth reverse surface of the tab is exposed and defines a single integrated layer maintaining a low profile (i.e. retaining a thickness approximate to the surrounding region of the hook layer) and without any significant weight addition.

Having described my invention, other and additional preferred embodiments will become apparent to those skilled in the art to which it pertains, and without deviating from the scope of the appended claims. This can include incorporating other methods for creating the smoothened and digit accessible surface location associated with the hook closure, such as included but not limited to any of incising, shearing or other abrading the subset area 20 depicted in FIG. 3 in order to remove a desired plurality of hooks 13, this in order to create the desired access profile for inserting the wearer's digits and again without the undesirable traits of creating a buildup of material at the separation interface or the attachment of separate panel or other material.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications that fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A releasable fastener assembly, comprising:

a first panel carrying an area of a first engagement material; and a second panel carrying an area of a second engagement material, wherein the first and second engagement materials are releasably securable to one another;

a portion of a perimeter of the area of the second engagement material defines a recess which extends in a direction nonparallel to an edge of the second panel and into the area of the second engagement material, wherein the second engagement material extends along the portion of the perimeter of the recess; and the recess is accessible from the edge of the second panel.

2. The releasable fastener assembly of claim 1, wherein the first engagement material comprises a plurality of loops.

3. The releasable fastener assembly of claim 1, wherein the second engagement material comprises a plurality of hooks.

4. The releasable fastener assembly of claim 1, wherein:

the first panel comprises a front portion of a ballistic vest garment; and the second panel comprises a closure panel of the ballistic vest garment.

5. The releasable fastener assembly of claim 4, with the closure panel releasably engaged to the front portion of the ballistic vest garment, the portion of the perimeter of the area of the second engagement material which defines the recess is positioned between the closure panel and the ballistic vest garment.

6. The releasable fastener assembly of claim 5, wherein a portion of the first engagement material aligned with the recess is unengaged.

7. A releasable fastener assembly, comprising:

a first panel carrying an area of a first engagement material; and a second panel carrying an area of a second engagement material wherein the second panel comprises an edge;

wherein the first and second engagement materials are releasably securable to one another; and the area of the second engagement material comprises a perimeter, wherein a portion of the perimeter, positioned between a first portion and a second portion of the perimeter, defines a recess which extends into the area of the second engagement material and in a direction nonparallel with respect to the edge of the second panel with the second engagement material positioned extending along the portion of the perimeter of the recess; and the recess is positioned between the first and second panels with the first engagement material of the first panel and the second engagement material of the second panel releasably engaged and the recess is accessible from the edge of the second panel and from between the first and second portions of the perimeter.

8. The releasable fastener assembly of claim 7, wherein the first engagement material comprises a plurality of loops.

9. The releasable fastener assembly of claim 7, wherein the second engagement material comprises a plurality of hooks.

10. The releasable fastener assembly of claim 7, wherein:

the first panel comprises a front portion of a ballistic vest garment; and the second panel comprises a closure panel associated with the ballistic vest garment wherein the closure panel releasably secures to the front portion of the ballistic vest garment.

11. The releasable fastener assembly of claim 10, with the closure panel releasably engaged to the front portion of the ballistic vest garment, a portion of the first engagement material in alignment with the recess is unengaged.

12. A releasable fastener assembly, comprising:

a first panel carrying an area of a first engagement material; and a second panel carrying an area of a second engagement material;

wherein the first and second engagement materials are releasably securable to one another; and the second panel comprises a tab, wherein the tab has a fold positioned at an edge of the second panel and the tab overlies a portion of the area of the second engagement material of the second panel;

the second engagement material is positioned along a perimeter of the tab surrounding at least a portion of the tab; and the tab provides a surface that extends from the edge of the second panel to the second engagement material positioned along the perimeter of the tab and the surface is accessible from the edge of the second panel.

13. The releasable fastener assembly of claim 12, wherein the tab overlies a portion of the second engagement material.

14. The releasable fastener assembly of claim 12, wherein the first engagement material comprises a plurality of loops.

15. The releasable fastener assembly of claim 12, wherein the second engagement material comprises a plurality of hooks.

16. The releasable fastener assembly of claim 12, wherein the tab is bonded to the second panel.

17. The releasable fastener assembly of claim 12 wherein the first panel comprises a front portion of a ballistic vest garment and the second panel comprises a closure panel wherein the closure panel releasably secures to the front portion of the ballistic vest garment.

18. The releasable fastener assembly of claim 17, with the closure panel releasably engaged to the front portion of the ballistic vest garment a portion of the first engagement material in alignment with the tab is unengaged.

* * * * *